US007101223B2

(12) United States Patent
Neumann et al.

(10) Patent No.: US 7,101,223 B2
(45) Date of Patent: Sep. 5, 2006

(54) COMPACT SEALED AND SHIELDED CONNECTOR

(75) Inventors: Günter Neumann, Remshalden-Buoch (DE); Erwin Daberger, Plüderhausen (DE); Tobias Schimmele-Brell, Weinstadt (DE)

(73) Assignee: ITT Manufacturing Enterprises, Inc., Wilmington, DE (US)

( * ) Notice: Subject to any disclaimer, the term of this patent is extended or adjusted under 35 U.S.C. 154(b) by 0 days.

(21) Appl. No.: 11/098,974

(22) Filed: Apr. 5, 2005

(65) Prior Publication Data

US 2005/0221670 A1 Oct. 6, 2005

(30) Foreign Application Priority Data

Apr. 6, 2004 (DE) ..... 10 2004 018 430

(51) Int. Cl.
*H01R 9/05* (2006.01)

(52) U.S. Cl. ..... 439/585; 439/610

(58) Field of Classification Search ..... 439/585, 439/578, 610, 98, 99
See application file for complete search history.

(56) References Cited

U.S. PATENT DOCUMENTS 4,583,809 A * 4/1986 Werth et al. ..... 439/585
4,614,398 A * 9/1986 Wright et al. ..... 439/579
4,634,208 A * 1/1987 Hall et al. ..... 439/610
4,799,902 A * 1/1989 Laudig et al. ..... 439/585
4,897,050 A 1/1990 Randolph
5,083,943 A * 1/1992 Tarrant ..... 439/583
5,102,351 A * 4/1992 Meshel ..... 439/607
5,499,934 A 3/1996 Jacobsen et al.
5,879,191 A * 3/1999 Burris ..... 439/584
5,888,097 A * 3/1999 DiCicco ..... 439/610
5,997,350 A * 12/1999 Burris et al. ..... 439/585
6,048,227 A * 4/2000 Rupp et al. ..... 439/610
6,250,963 B1 6/2001 Wright
6,733,336 B1 * 5/2004 Montena et al. ..... 439/578
6,817,896 B1 * 11/2004 Derenthal ..... 439/578
6,857,902 B1 * 2/2005 Mehnert et al. ..... 439/579
2002/0119699 A1 8/2002 Leve

FOREIGN PATENT DOCUMENTS

DE 964291 5/1957
FR 1448436 6/1966

* cited by examiner

*Primary Examiner*—Gary Paumen
(74) *Attorney, Agent, or Firm*—Peter Van Winkle

(57) ABSTRACT

A connector (10) is connected to the front end of a cable (11) in a compact connection that provides electrical shielding and a water-tight seal. The connector has a metal main sleeve (30) with a rear end (64) having circular crimps (38,39). One crimp (39) is made against the cable insulator (16) to provide a water-tight seal and the other (38) is made to the cable shielding braid (35) to ground the main sleeve. The main sleeve has a front portion with a crimp (37) that crimps against an elastic seal ring (25) lying in a groove (23) in an insulative body (20) that has contact-holding passages (60).

9 Claims, 3 Drawing Sheets

COMPACT SEALED AND SHIELDED CONNECTOR

CROSS-REFERENCE TO RELATED APPLICATION

Applicant claims priority from German patent application 102004018430.5 filed Apr. 6, 2004.

BACKGROUND OF THE INVENTION

The present invention relates to an electrical and mechanical connecting arrangement comprising a preferably multi-wire cable and a cylindrical connector part in the form of a plug or socket.

In prior connecting arrangement, the connector part is held with its rear hollow end, which is remote from the plugging region, on a radio frequency cable by means of a crimped connection. The front end of the plug connector part has an insulating part lying about a socket or plug contact and, on the outside, a shielding contact. With such plug connector parts, the individual components of the plugging region are generally connected to one another and to a hollow housing, in whose rear end the cable is inserted, by means of screw fittings and/or latching connections. Such connections are relatively complex in terms of production and assembly. In addition, such connections require a relatively large amount of space.

One object of the present invention to provide an electrical and mechanical connecting arrangement of the type mentioned above, in which the connection between the insulated cable and the plugging region is simplified for assembly and can be used in connecting arrangements having a small physical size.

SUMMARY OF THE INVENTION

In accordance with one embodiment of the invention a compact, simple, and easily assembled cable connector is provided that can be assembled even on the end user's premises. The connector is assembled in a simple manner to a cable by crimping of front and rear end portions of a metal main sleeve, which forms a protective housing. The main sleeve rear position is crimped to the cable insulation to seal against it, and is crimped against a metal shield of the cable to ground the main sleeve. The main sleeve front portion is crimped against an elastic seal in a groove of a contact holding insulative body at the connector front end to seal against it.

Further details of the invention are described in the description below in which the invention will be described and explained in more detail with reference to the exemplary embodiment illustrated in the drawing, in which.

DETAILED DESCRIPTION OF THE INVENTION

Figure 1:
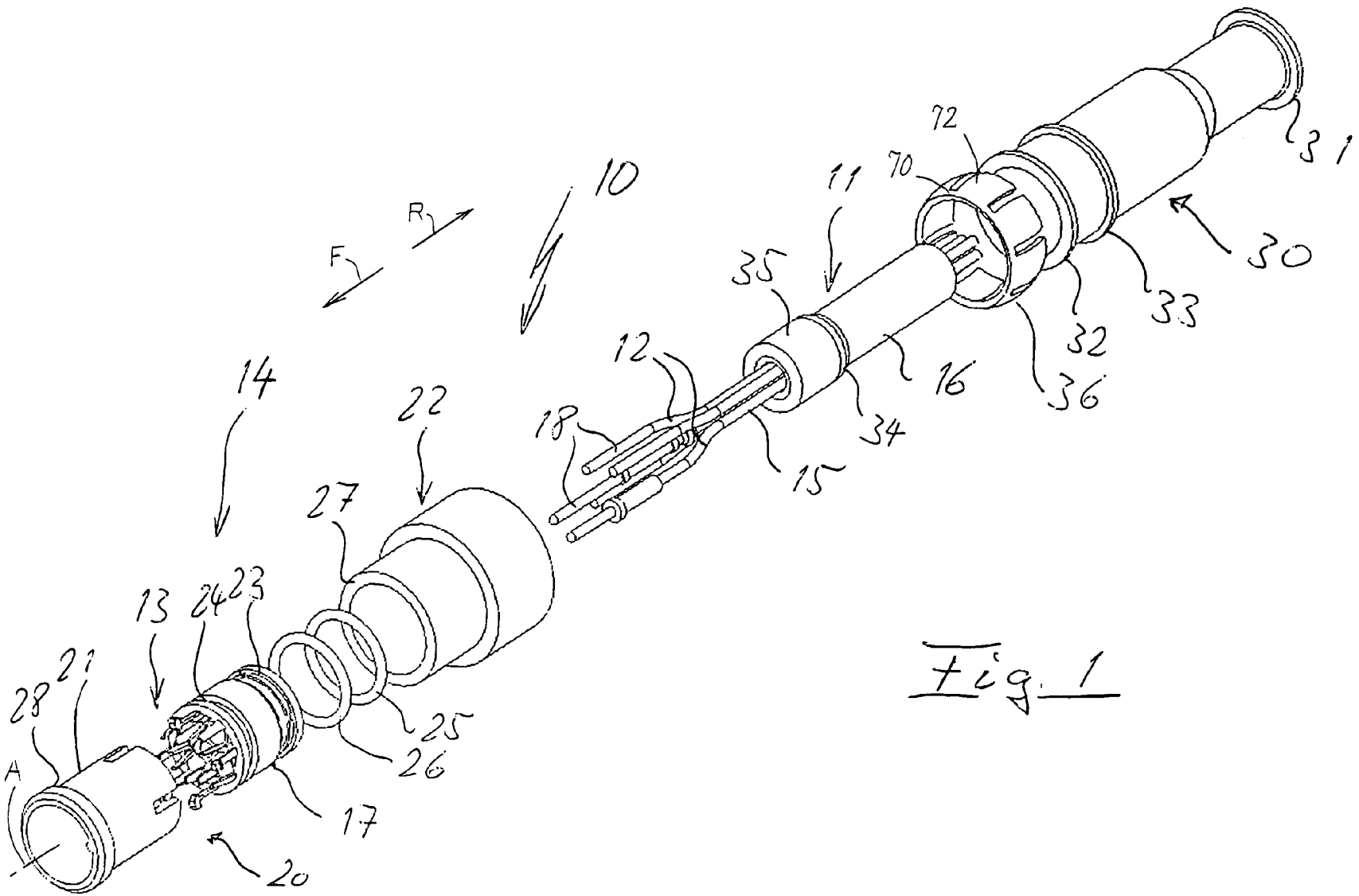
FIG. 1 is an exploded and sectional isometric view of a connector of the present invention and of a cable.

FIG. 1 shows an essentially cylindrical connecting arrangement 10 which extends in front F and rear R directions along an axis A and which connects a multi-conductor cable 11 to a plugging or connect region 13 of a connector 14. The cable has individual wires 12 that have wire insulation, and each wire has a bared front end connected to a contact 18. FIG. 1 shows five wires and contacts.

Figure 2:
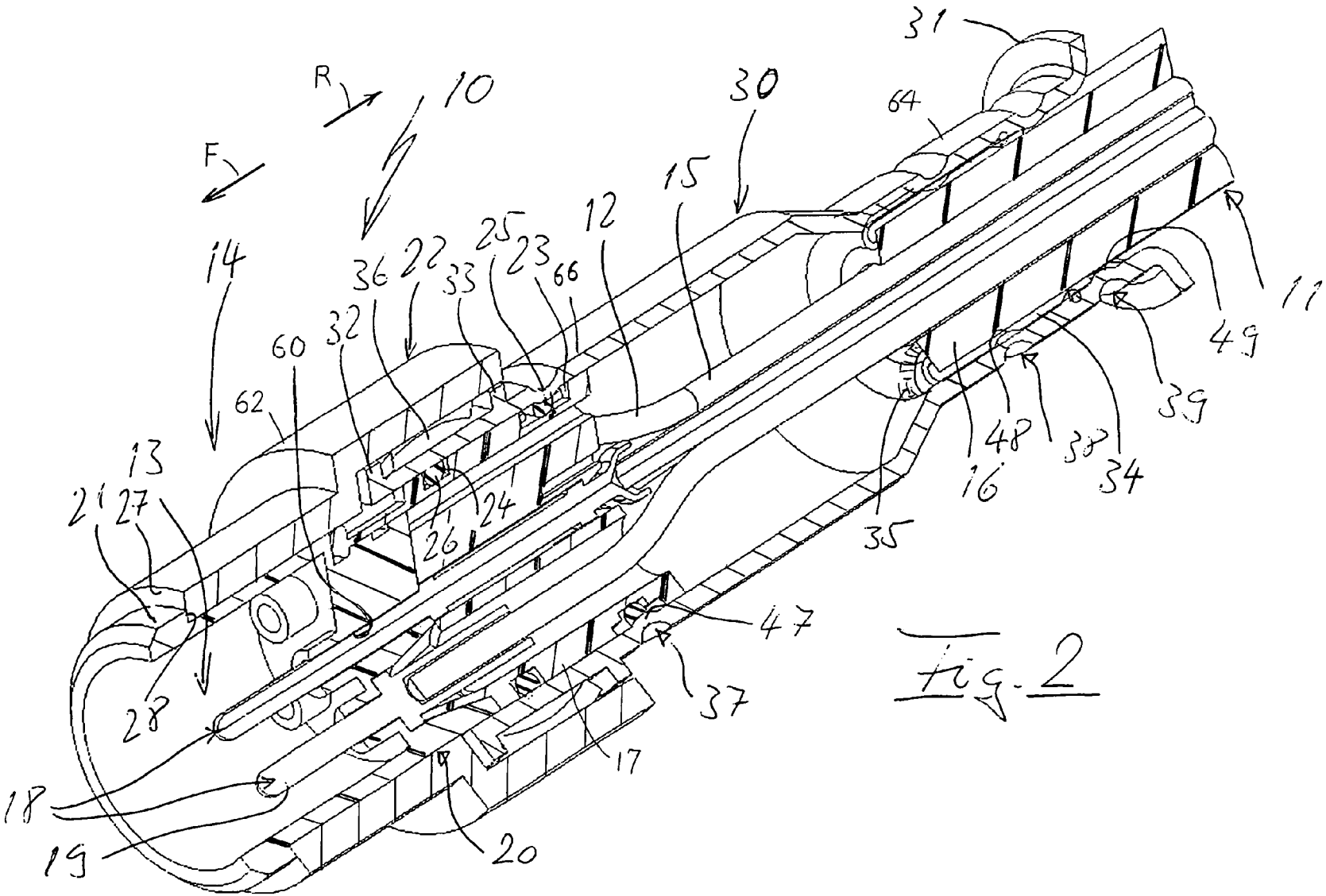
FIG. 2 is a sectional isometric view of the connector and cable combination of FIG. 1, shown in an assembled state.

The wires 12 of the cable are surrounded by cable insulation 16. The connector 14 has a two-part insulating body 20 that receives the contacts, including a rear bushing part 17 and a body front sleeve 21 that latches to the rear bushing part. As shown in FIG. 2, the contacts 18 are held in passages 60 in the body so the contacts cannot be displaced axially, and with their free front mating ends 19 being free to mate to other contacts. The contact front ends lie within the protruding insulating sleeve 21. Such an insulating body 20 may instead be provided with socket contacts.

The two-part insulating body 20 is surrounded by a metallic, stepped connecting sleeve 22. The connecting sleeve can instead be provided with a front region having a smaller diameter and with outer threads or a bayonet connection part, for mechanical connection to a mating socket/plug connector device. The connecting sleeve 22 has a front end face 27 that bears against a shoulder 28 of the insulating sleeve 21 of the body. The largest diameter rear portion 62 of the connecting sleeve 22 has a knurled outside for gripping.

The insulating body 20 has a front end region which accommodates the front ends of the contacts 18 and a rear end region that receives the insulated wires 12 and/or the contact rear ends. The body 20 has two axially spaced annular grooves 23 and 24, which each holds an elastomeric, or elastic seal in the form of an O-ring 25, 26. In one variant (not shown), the two O-rings 25, 26 are replaced by a sealing collar.

A stainless steel metal main sleeve 30, having thin walls, is pushed over the cable 11. The main sleeve has a rear end with an outward annular flange 31. The main sleeve front end portion has two outward flanges 32, 33. The main sleeve 30 extends from its rear region 64 which has a small diameter and which surrounds the cable 11 to its front end portion 66 which has a large diameter. The insulating body 20 fits in the main sleeve front end portion and the connecting sleeve 22 fits around the main sleeve front end portion, or front end.

Figures 2A, 3:
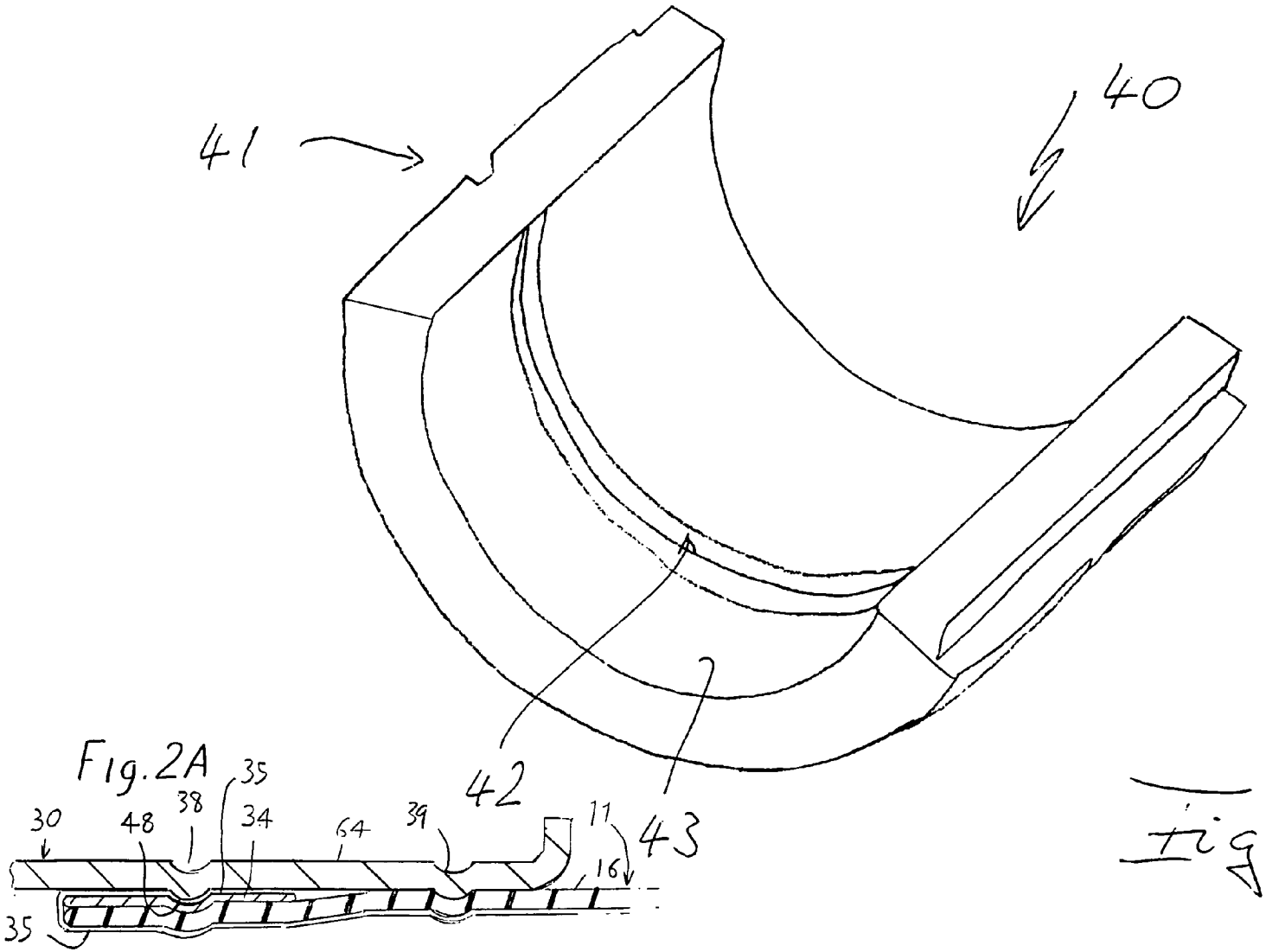
FIG. 2A is a partial sectional view showing connection of the main sleeve to a metal shield of the cable.
FIG. 3 is an isometric view of a part of a crimping tool for achieving a connecting arrangement in a variant relating to FIG. 2.

In the embodiment illustrated, the cable 11 has a shielding braid, or shield 35 (FIG. 2A). When cable insulation 16 is removed, it exposes the braided metal cable shield 35. The shield 35 is folded backward around a cup-shaped conductive metal tube 34 that has been slid onto the exposed shield.

The main sleeve 30 acts as a mechanical and electrical shield. It provides a mechanically fixed connection and seal, against the cable outer insulation 16 at a crimp 39. It also provides an electrical connection with the braided metal cable shield 35 of the cable 11. The cable shield 35 is maintained at a constant potential (usually ground) and the electrical connection keeps the main sleeve 30 at ground potential to better shield the wires and contacts from electromagnetic interference. The two elastomeric, or elastic seals in the form of O-rings 25, 26 (FIG. 2) are fitted over the insulating body 20 in grooves 23, 24. The insulating sleeve 21 of the body is moved rearward into the rear bushing part 17 of the body and latched to the bushing part.

At that time the connecting sleeve 22 has been fitted over the insulating sleeve 21 and lies against its shoulder 28.

To install the front end of the main sleeve, a spring basket 36 is installed around the main sleeve 30, between the two annular flanges 32, 33. As shown in FIG. 1, the spring basket has a continuous ring part 70 and a plurality of finger parts 72 projecting primarily parallel to the axis A but at inclines to the axis. The main sleeve front end lies around the bushing part 17 (FIG. 2) of the insulative body. The O-rings 25, 26 press outward against the main sleeve and inward against a rear, part of the body 20. This results in both an electrical and mechanically frictional connection between the metal main sleeve 30 and the metal connecting sleeve 22, and (after crimping) a water-tight seal between the main sleeve and the body 20.

In this position, three 360° circumferential crimps at 37, 38, and 39 are made on the outside of the metal main sleeve 30. The first crimping connection 37 is made for the purpose of connecting the main sleeve 30 to the insulating body 20. The connection is made, in the region of the annular groove 23, which lies rearward of the connector sleeve 22 and which contains the O-ring 25. A radially inward part 47 of the crimp deforms the O-ring 25 and partially engages walls of the annular groove 23. As a result, a mechanical connection of the main sleeve 30 to the rear part 16 of the insulative body is achieved which is moisture-tight. Owning to the high level of friction between the main sleeve 30 and the O-ring 25, a connection is also achieved which is fixed against rotation.

The second crimp 39 at the rear portion of the main sleeve forms a groove in the main sleeve 30 close to the annular flange 31. The resulting inward deformation 49 compresses the insulating sheath 16 of the cable 11. As a result, a connection is achieved which is moisture-right, which is mechanically resistant to tensile stress, and which is fixed against rotation.

A third crimp 38 in the rear portion of the main sleeve is made around the cup-shaped metal sleeve 34 and the turned-back shielding braid 35. FIG. 2A shows that this produces an inward deformation 48 of the metal main sleeve 30 which clamps onto the shielding braid 35 that lies on the outside of the metal tube 34. The metal tube 34 is required to maintain the force of the crimp against the braid. The result is that the main sleeve 30 provides electromagnetic shielding of the cable wires 12 (FIG. 2) from which the shielding braid has been stripped, and provides shielding of the connection region of the wires 12 to the plug contacts 18 in the insulating body 20. The crimping transfers the shielding of the cable to the main sleeve 30, and from the main sleeve through the spring basket 36 to the connecting sleeve 22 and to any mating connector device.

In the drawing, the groove-like deformations 47, 48, and 49 of the crimping connections 37 to 39 are of identical design; that is, the height of the deformations 47 to 49 which protrude radially inwards, is the same over the entire inner circumference. In one embodiment which is not illustrated in detail, the deformations 37 to 39 are such that they have a maximum height or a minimum height at two diametrically opposite regions. In other words, in each case over a range of 180°, the deformations 27 and 29 are, with respect to their height (radial dimension), in the form of a sickle, or half of a sine wave, when viewed in the axial direction, such that they extend from a height close to or equal to zero over a maximum height and again to a height close to or equal to zero.

The illustrated configuration of the bead-like deformations 27 to 29 are made with a crimping tool 40, which is illustrated schematically and only partially in FIG. 3, and which comprises two half-shells 41. Each half-shell 41 has on its inside, a shaping projection 42, which points radially inwards. The shaping projection has a radial height that varies from zero to a maximum value, and to a value close to or equal to zero, i.e. is in the form of a sickle or sine wave when viewed axially.

This configuration of the two tool half-shells 41 has the advantage at the point where the two tool half-shells 41 meet one another radially, i.e. in the separation plane, no deformation of the metal sleeve 30 is brought about during the crimping operation in the axial direction.

Owing to the design or the connection described, a structurally very small connecting apparatus 10 is achieved which has, for example, a maximum diameter at the connecting sleeve of approximately 15 mm and a length from the front end of the closure sleeve 21 to the rear end 31 of the metal main sleeve 30 of approximately 55 mm.

Mention should also be made of the fact that this connecting arrangement can also be used in the case of single-conductor or wire cables, in particular in the case of coaxial cables.

Thus, the invention provides a compact and easily assembled electrical connector for connecting to a cable. A metal main sleeve has a rear portion with a circumferential first rear crimp that presses against the cable outer insulation. The main sleeve rear portion has a second rear crimp that presses against a cable shield to ground (keep at a constant potential) the main sleeve. The main sleeve has a front portion with a circumferential crimp that projects into a groove in an insulative body and compresses an elastic seal in the groove. The main sleeve front portion also carries a spring basket that electrically connects to a metal connecting sleeve that surrounds the main sleeve front end.

The invention claimed is:

1. An electrical connector for a cable that has an insulative cable sheath and at least one wire, wherein the connector has at least one contact connected to a front end of the wire, and wherein the connector includes an insulative contact-holding body with at least one passage that receives the contact, including:

a metal main sleeve that has a rear portion that surrounds a front end of the cable sheath and that has a front end that surrounds at least part of said contact-holding body;

said main sleeve rear portion being crimped to the insulative cable sheath to form a main sleeve crimp thereat, and said main sleeve having a front portion that is crimped around said contact-holding body to form a main sleeve crimp thereat.

2. The connector described in claim 1 wherein:

said crimp of said main sleeve to said insulative cable sheath and to said contact-holding body are each in the form of a groove that extends completely around the main sleeve.

3. The connector described in claim 1 wherein said connector has an axis and wherein:

said contact-holding body has a radially outwardly opening groove and said crimp of said main sleeve front portion extends onto said groove.

4. The connector described in claim 3 including:

an elastomeric seal ring that lies in said groove and that is compressed by said said crimp of said main sleeve front portion.

5. The connector described in claim 1 wherein said connector has an axis and wherein:

at least one of said crimps extends around said axis and varies in depth around said axis, with at least two parts at diametrically opposite sides of said axis which are of minimum depth.

6. The connector described in claim 5 wherein:

said at least one of said crimps varies sinusoidally in depth with position around said axis.

7. The connector described in claim 1 wherein said cable has a metal cable shield and including a metal tube lying about said cable shield, said cable shield having a wrapped-backward shield front end portion that is wrapped backward around said metal tube, and wherein:

said main sleeve rear portion has a third circumferential crimp that forms a bead that presses against said cable shield wrapped backward front portion, to thereby ground the main sleeve when the cable shield is grounded.

8. An electrical connector with an axis, and a cable with a cable front end connected to the connector, the cable having at least one wire with a front end and including at least one contact connected to said wire front end, the connector having an insulative contact-holding body with at least one passage that receives the contact and the connector having a metal main sleeve that has a main sleeve front portion that surrounds at least part of said body, wherein:

said main sleeve front portion forms a radially inward circumferential crimp that holds said main sleeve front portion to said body, said body having a circumferentially extending groove and said crimp forming a bead that extends into said groove; and including an elastic seal ring lying in said circumferential groove of said insulative body, said radially inner circumferential crimp in said main sleeve front portion compresses said elastic seal.

9. An electrical connector with an axis, and a cable with a cable front end connected to the connector, the cable having at least one wire with a front end and including at least one contact connected to said wire front end, the connector having an insulative contact-holding body with at least one passage that receives the contact and the connector having a metal main sleeve that has a main sleeve front portion that surrounds at least part of said body, wherein:

said main sleeve front portion forms a radially inward circumferential crimp that holds said main sleeve front portion to said body, said body having a circumferentially extending groove and said crimp forming a bead that extends into said groove; and including a metal connecting sleeve lying at a front of said connector, said connecting sleeve having a rear portion that surrounds said front portion of said main sleeve:

a metal spring basket that includes a ring part and a plurality of finger parts projecting primarily parallel to said axis but at radial inclines to said axis from said ring part, said main sleeve front portion having a basket-holding groove that holds said spring basket, with said spring pressing against walls of said basket-holding groove and against an inner surface of said connecting sleeve.

* * * * *